United States Patent [19]

Jukkola et al.

[11] 4,085,516

[45] Apr. 25, 1978

[54] FLUIDIZED BED DRYING PROCESS FOR POROUS MATERIALS

[75] Inventors: Walfred Wilhelm Jukkola, Westport; Richard Ernest Svencer, Norwalk, both of Conn.

[73] Assignee: Dorr-Oliver Incorporated, Stamford, Conn.

[21] Appl. No.: 728,332

[22] Filed: Sep. 30, 1976

[51] Int. Cl.[2] ..... F26B 3/08

[52] U.S. Cl. ..... 34/10; 432/15

[58] Field of Search ..... 34/10, 57 A; 432/14, 432/15, 58

[56] References Cited

U.S. PATENT DOCUMENTS

| | | | |
|---|---|---|---|
| 2,650,084 | 8/1953 | White | 432/15 |
| 3,892,538 | 7/1975 | Seth | 432/15 |
| 3,938,259 | 2/1976 | Ormos et al. | 432/14 |

FOREIGN PATENT DOCUMENTS

| | | | |
|---|---|---|---|
| 951,245 | 3/1964 | United Kingdom | 34/57 A |

*Primary Examiner*—John J. Camby

*Attorney, Agent, or Firm*—Burtsell J. Kearns; Harold M. Snyder

[57] ABSTRACT

Porous, moisture-containing materials are dried in a fluidized bed reactor. The moisture content of both the underflow and carryover products from the dryer are controlled by introducing hot gases into the freeboard region above the fluidized bed. One or more tuyeres of extended length with ports at a level above the fluidized bed in the freeboard regin may be employed to admit hot gases directly into the freeboard region from the reactor windbox without traversing the fluidized bed. Alternatively, a valved conduit may be employed extending through the refractory dome or gas distributor to regulate gas flow between the windbox and the freeboard region.

2 Claims, 4 Drawing Figures

FLUIDIZED BED DRYING PROCESS FOR POROUS MATERIALS

This invention is directed to a process in which low-temperature drying of moist, porous materials is carried out in a fluidized bed reactor.

The drying of certain porous materials, where some of the free water is in the internal pores of the particles, presents substantial difficulty. The removal of this moisture requires a considerable detention time in the reactor, since the particle must first be heated and the water brought to the particle surface by diffusion or capillary action before evaporation and removal of the water from the particles can be accomplished.

In the fluidized bed dryers used in commercial practice, the delayed drying of such moist, porous substances causes severe temperature drop in the system from the bed to the freeboard, cyclones and ducts. The temperature drop is, of course, due to the continuing drying of the particles which are elutriated into the freeboard and then into the cyclones and ducts. The drying action continues until the saturation temperature is reached. When the saturation temperature is attained in the apparatus, water vapor condenses on the particles, the duct work and other structure due to the continued heat loss from the system. A possible consequence is the plugging of the cyclone and ducts causing shut-down of the system.

On the other hand, the rate of drying increases with increase in the differential between the saturation temperature and the gas temperature.

While it would be possible to overcome these difficulties by increasing the bed temperature, this is not a practical solution in many cases where the bed temperature must be limited due to the construction of the product handling system, or the nature of the solids undergoing treatment.

There is a real need, then, for a process which will effectively dry porous materials at relatively low drying temperatures.

It is the object of this invention to provide a process which will effectively dry porous materials at relatively low bed temperatures while controlling the moisture content of the carryover product and avoiding condensation of moisture in the exhaust gas ducts and cyclones.

Other objects and advantages will become apparent to those skilled in the art from the following description, taken in conjunction with the drawings in which.

The present invention involves drying, at relatively low temperatures, a body of particulate, moist, porous solids fluidized in an up-flowing stream of heated gas wherein a portion of the heated gas by-passes the fluidized bed and is directed into the freeboard region above the fluidized solids.

More specifically, the fluidizing gases may be heated to a temperature in the range from about 1200° to about 2000° F; the drying solids in the fluidized bed are maintained at a temperature in the range from about 160° to about 325° F and the freeboard region above the fluidized bed is maintained at a temperature in the range from about 160° to about 325° F.

It should be noted that it is not desired to exceed a temperature of about 325° F in the fluidized bed to avoid problems with the product handling system or with the bed solids.

The means by which hot gases are passed from the windbox region of the fluidized bed reactor to the freeboard region may be either a tuyere of extended length with the tuyere ports at a level above the expanded fluidized bed or a valved conduit extending from the windbox through the constriction dome and the fluidized bed and into the freeboard region, with a simple cone valve for regulating the flow of hot gases.

In certain prior art high-temperature multi-bed fluidized bed operations, a gas by-pass has been employed to prevent overheating of the pre-heat bed. The hot off-gases of the pre-heat compartment freeboard region are routed through a cage mill which receives a re-pulped feed for delivery to the pre-heat compartment. See U.S. Pat. No. 2,650,084, issued Aug. 25, 1953. The problem of high moisture content of material elutriated from the bed does not arise due to the high bed temperature (1000° F) being maintained.

Figure 1:
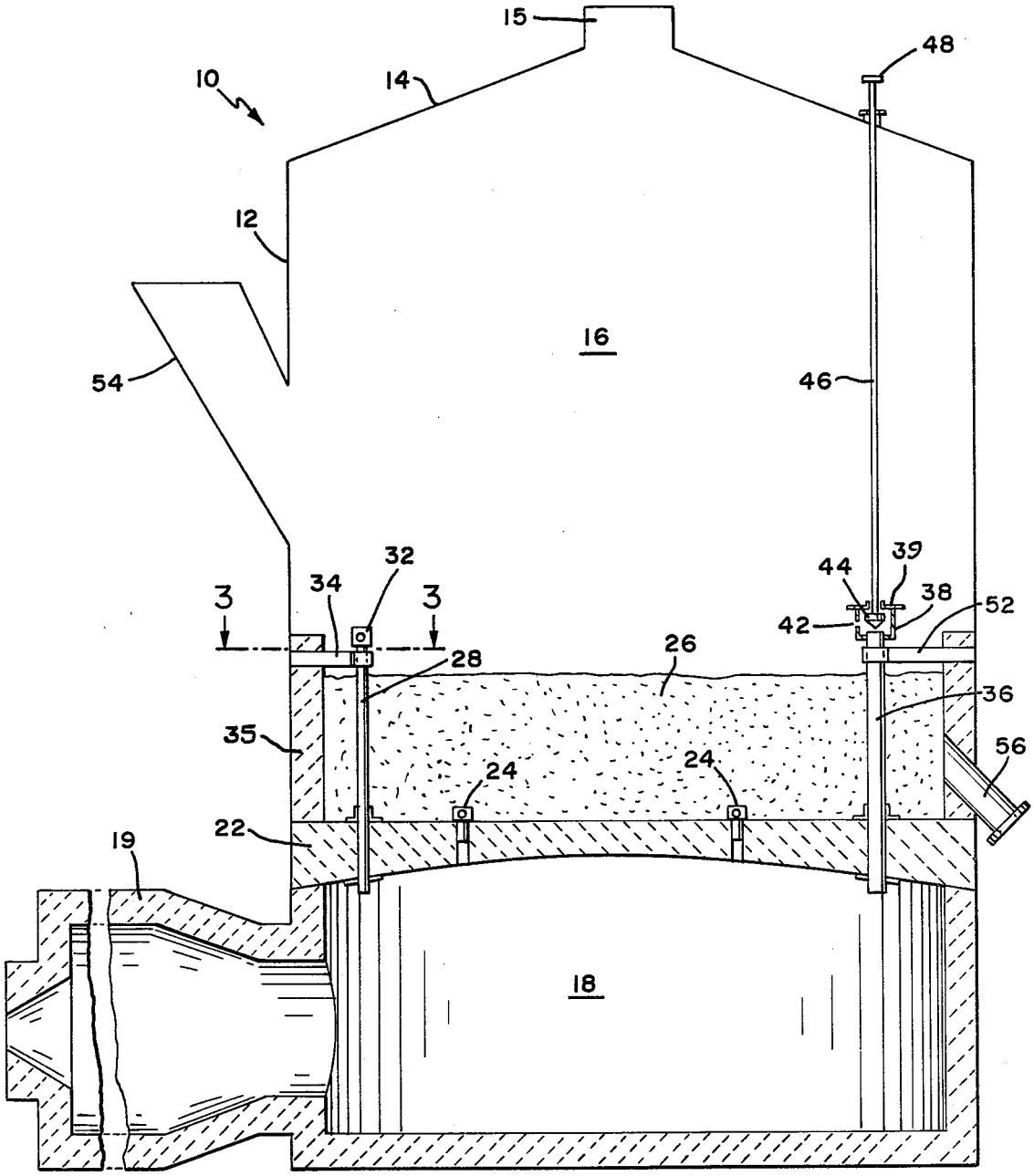
FIG. 1 is a schematic view of a fluid bed reactor suitable for carrying out the process of the invention.

Referring to FIG. 1, the reactor 10 comprises an outer shell 12 which is capped by a cover or roof 14. Within shell 12, the reactor 10 is provided with a constriction plate 22 having a reaction chamber 16 thereabove and a windbox 18 therebelow. A burner 19 is in communication with the windbox 18. The refractory constriction dome 22 has a plurality of conventional tuyeres 24 therein of which two are illustrated. A feed inlet 54 provides access to the reaction chamber 16 so that additional feed solids may be introduced into the reactor. A product conduit 56 is also provided so that product solids may be withdrawn from the reactor. Off-gases from the reactor exit through outlet 15 in roof 14 of the reactor. A fixed tuyere 28 of extended length communicates the windbox with the reaction chamber 16, the port portion 32 of the tuyere being positioned well above the upper surface of the fluidized bed 26. Support arm 34 is anchored in the refractory lining of the shell 12 and supports the tuyere 28 at the upper end thereof.

Figure 2:
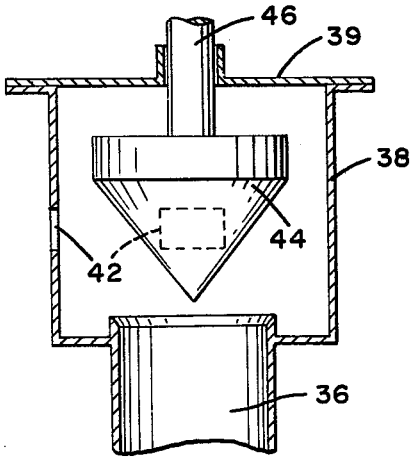
FIG. 2 is an enlarged view of the valve end of a valved conduit suitable for use in the process of this invention.
Figure 3:
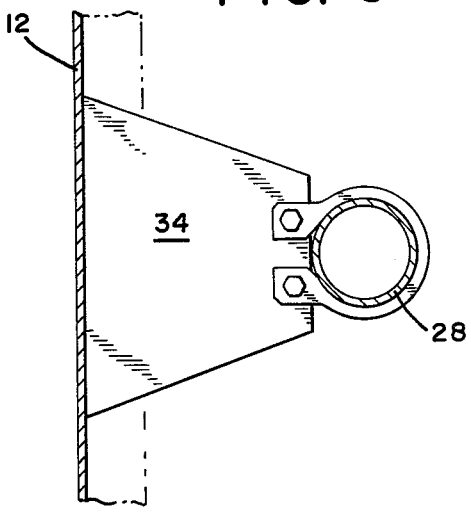
FIG. 3 is a plan view showing the support arm for the extended tuyere used in connection with the process of the invention.

The conduit 36 extends from the windbox 18 through the refractory constriction dome 22 and the fluidized bed 26 and projects into the reaction chamber 16 above the level of the fluidized bed 26. The upper end of the conduit 36 opens into an enclosure 38 which has a plurality of ports 42 in the sides thereof (see FIG. 2). A valve stem 46 having a handle 48 at the upper end thereof penetrates the roof 14 of the fluidized bed reactor and extends through the top 39 of enclosure 38 and is connected to cone valve 44 positioned within enclosure 38.

Figure 4:
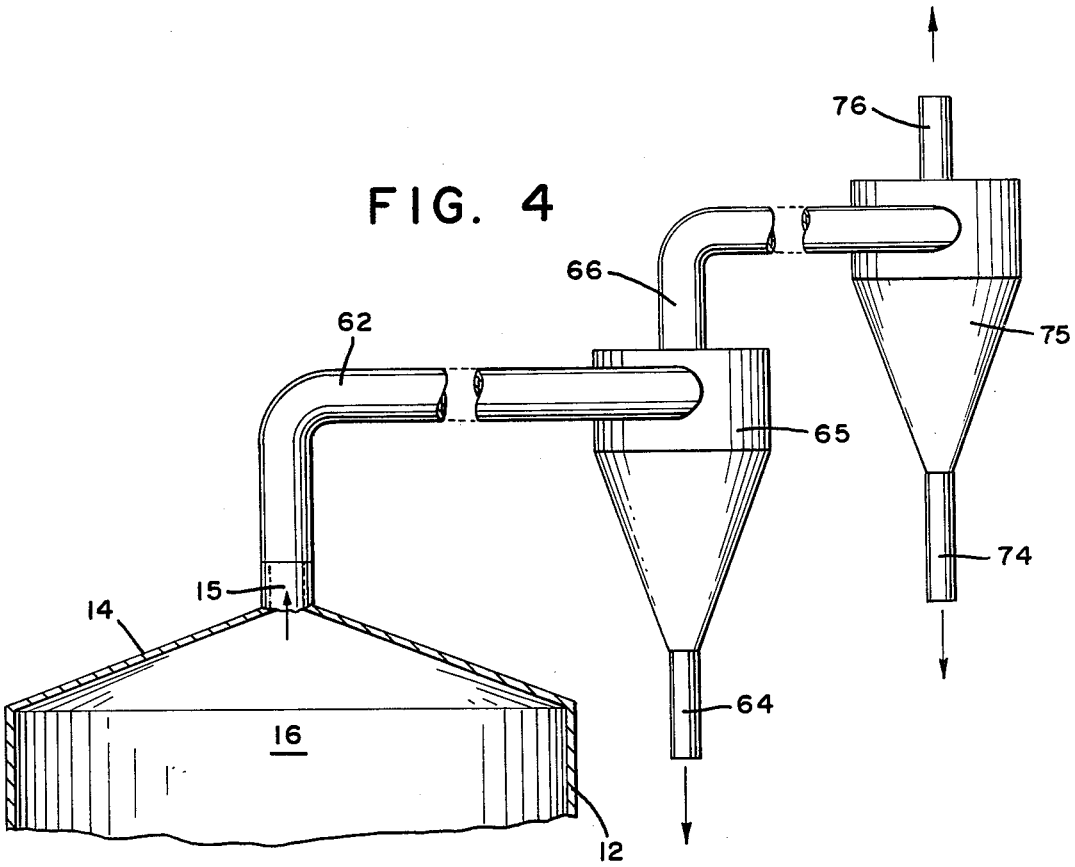
FIG. 4 is a schematic view of the exhaust gas and cyclone system used in connection with the reactor of FIG. 1.

In FIG. 4 the exhaust gas system of reactor 10 is illustrated. Thus, the off-gas conduit 15 in roof 14 of the reactor 10 is connected to conduit 62 which, in turn, provides communication with the primary cyclone 65. Cyclone 65 is provided with a solids discharge conduit 64 at the bottom thereof and a gas conduit 66 at the top thereof which communicates with a secondary cyclone 75. Cyclone 75 has a solids discharge conduit 74 at the bottom thereof and an exhaust gas conduit 76 at the top thereof from which the gases flow to the final gas cleaning stage, bag filter, scrubber or other device.

The materials which may be treated in accordance with this low-temperature drying process are certain phosphate rocks, for example, phosphate rock from Algeria, coal from the western part of the United States, certain lignites, synthetic single cell protein material and polymers, such as polyvinylchloride.

In operation, a quantity of moist, particulate solids is introduced through the feed inlet 54 and rests on the constriction dome 22. Fuel and air are injected (by means not shown) into the burner 19 for combustion. The combustion gases are then routed to the windbox 18. The bulk of the hot gases from the windbox 18 pass through the tuyeres 14 into the reaction chamber 16, fluidizing the material in the bed 26 and traversing the freeboard region to the exhaust conduit 15. A portion of the hot gases by-passes the fluid bed 26 by passing through the extended tuyere 28 or through a valved by-pass 36. The exhaust gases pass through cyclones 65 and 75 arranged in series, each of the cyclones removing solid particulate matter from the exhaust gases. A part of the bed material is elutriated into the freeboard region before drying is completed. Combustion gases routed directly to the freeboard region through either the extended tuyere 28 or the by-pass 36 serve to complete the drying process of the elutriated material in the freeboard region and exhaust gas system.

In order to illustrate the advantages of the present invention, the following data, applicable to a fluidized bed dryer operating on a feed of a moist (12% $H_2O$), porous, phosphate rock and a combustion gas volume of 60,000 scfm, is presented.

TABLE I

| | Bed | Freeboard | Primary Cyclone | Secondary Cyclone |
|---|---|---|---|---|
| Temperature (° C.) | 110(230° F) | 85(185° F) | 75(167° F) | 70(158° F) |
| % Product Distribution | 40–50% | | 40–50% | 5–10% |
| Product Moisture (% $H_2O$) | 0.4 | | 1.5 | 2.2 |

The dew point of the gases is from about 65° C (150° F) to 70° C (151° F). It is evident from the above table that some condensation of the water vapor is occurring in the secondary cyclone with 2.2% $H_2O$ present. Further, the large temperature drop from bed to freeboard region to primary cyclone is due to the continuing drying of the particles. This evaporation process obtains its heat supply from the fluidizing and stack gases and thus the temperature must decrease to satisfy the heat balance requirements. The above process has the disadvantage that, while the bed product may be dry enough, the carryover product has an excessive moisture content.

In order to illustrate the practice of the present invention, the fluidized bed dryer in which the above data was taken is operated with a combustion gas by-pass of either the extended tuyere type or of the valved conduit type. Essentially the same volume of combustion gas (60,000 scfm) is employed with about 10% by volume of the combustion gas by-passed. The combustion gas is at a temperature of about 950° C (1750° F) to about 980° C (1800° F). The feed is a phosphate rock containing 12% $H_2O$. The following data is obtained using such procedure:

TABLE II

| | Bed | Freeboard | Primary Cyclone | Secondary Cyclone |
|---|---|---|---|---|
| Temperature (° C.) | 110(230° F) | 115(239° F) | 110(230° F) | 100(210° F) |
| Product Moisture (% $H_2O$) | 0.4 | | 0.1 | 0.05 |

The product distribution is the same as indicated in Table I. From the above Table II it is seen that both the underflow and overflow products have comparably low moisture contents, and thus the drying procedure has been effective.

Although the present invention has been described in conjunction with preferred embodiments, it is to be understood that modifications and variations may be resorted to without departing from the spirit and scope of the invention, as those skilled in the art will readily understand. Such modifications and variations are considered to be within the purview and scope of the invention and appended claims.

We claim:

1. A fluidized bed drying process for moist, porous, particulate materials comprising the steps of, providing a body of fine particulate solids composed of said moist, porous materials, heating a gas to a temperature in the range from about 1200° to about 2000° F, passing a major portion of said hot gas through said body of particulate solids to fluidize same and establish in the fluidized body a temperature in the range from about 160° to about 325° F whereby large quantities of moisture are evaporated from said fluidized body, said gas, in moving through said fluidized bed, elutriating fine, moist particles of said particulate solids into the freeboard region above said bed, introducing a second smaller portion of said hot gases into a conduit traversing said fluidized bed and discharging this portion directly into the freeboard region above said fluidized bed in a volume sufficient to maintain in said freeboard region a temperature in the range from about 160° up to about 325° F so that the fine particles elutriated from said fluidized body are subjected to the temperature prevailing in the freeboard region and evaporation of moisture from said fine particles continues in said freeboard region and in the exhaust gas system.

2. The process of claim 1 wherein the volume of hot gases flowing through said conduit is controlled to satisfy the requirement for drying in said freeboard region.

* * * * *